US006508208B1

(12) United States Patent
Frasure et al.

(10) Patent No.: US 6,508,208 B1
(45) Date of Patent: Jan. 21, 2003

(54) WATER HEATER WITH ARRANGEMENT FOR PREVENTING SUBSTANTIAL ACCUMULATION OF SEDIMENT AND METHOD OF OPERATING SAME

(76) Inventors: Charles J. Frasure, 170 Park St., Blackfoot, ID (US) 83221; Greg A. Frasure, 170 Park St., Blackfoot, ID (US) 83221; Paul J. Frasure, 170 Park St., Blackfoot, ID (US) 83221; Blake D. Frasure, 1830 Rainier, Pocatello, ID (US) 83201

( * ) Notice: Subject to any disclaimer, the term of this patent is extended or adjusted under 35 U.S.C. 154(b) by 0 days.

(21) Appl. No.: 09/929,495

(22) Filed: Aug. 15, 2001

(51) Int. Cl.[7] ..... F02D 7/00
(52) U.S. Cl. ..... 122/388; 122/380; 392/457
(58) Field of Search ..... 122/4 A, 13.01, 122/14.3, 14.31, 35, 380, 383, 384, 388, 390; 126/387.1; 392/446, 447, 451, 457

(56) References Cited

U.S. PATENT DOCUMENTS 3,762,395 A 10/1973 Taylor
4,148,731 A 4/1979 Brigante
4,347,133 A 8/1982 Brigante
4,505,231 A * 3/1985 Syler ..... 122/383
4,844,927 A 7/1989 Morris, II et al.
4,858,563 A * 8/1989 Perry ..... 122/390
5,134,683 A * 7/1992 Powell ..... 392/449
5,152,843 A 10/1992 McDonald et al.
5,220,638 A 6/1993 Moore et al.
5,341,770 A * 8/1994 Lannes ..... 122/380
5,609,124 A * 3/1997 Leclerc ..... 122/388
5,921,207 A * 7/1999 DiSalvo et al. ..... 122/388
5,923,819 A * 7/1999 Ross et al. ..... 392/451
6,295,411 B1 * 9/2001 Fastman ..... 122/4 A

* cited by examiner

*Primary Examiner*—Gregory Wilson
(74) *Attorney, Agent, or Firm*—Lowe Hauptman Gilman & Berner, LLP

(57) ABSTRACT

An automatic self-cleaning electric or gas water heater has a sloped conical bottom wall and a manifold such that water flowing through the manifold gently washes sediment to the bottom wall. The sediment slides along the bottom wall to a bottom drain. The sediment and water in the tank bottom periodically flow through the drain by operation of a controller which activates a solenoid valve.

25 Claims, 4 Drawing Sheets

WATER HEATER WITH ARRANGEMENT FOR PREVENTING SUBSTANTIAL ACCUMULATION OF SEDIMENT AND METHOD OF OPERATING SAME

RELATION TO PREVIOUSLY FILED APPLICATION

The present invention is an improvement on the invention disclosed in the co-pending application of Frasure, et al., Ser. No. 09/016,982, filed Feb. 2, 1998.

FIELD OF INVENTION

The present invention relates generally to water heaters having provisions for preventing substantial accumulation of sediment and to a method of operating same and, more particularly, to such a water heater and operating method wherein sediment in the water is gently washed to a selectively opened drain at the lowest point of the tank and is removed from time to time from the drain.

BACKGROUND ART

As a result of use, particulate sediment accumulates in water heater tanks. The sediment enters the tank with cold water or is produced in the tank in response to elevated water temperatures that produce carbonates in the tank. In either case, the sediment settles to the bottom of the water heater where it accumulates. Frequently, the sediment accumulates to such an extent that an electric water heater coil becomes completely covered, reducing heat exchange efficiency materially, and possibly causing the coil to become overheated to such an extent that the coil breaks. In gas water heaters, the sediment accumulates between a burner and the water to reduce the heat transfer efficiency. In electric and gas water heaters, the sediment coats the interior walls of the tank, adversely affecting heater efficiency.

In some prior art water heaters, the incoming water supply is directed towards the base so as to dislodge and disperse the particulate sediment. It has also been proposed to disperse sediment by using a special nozzle that creates a swirling action. This special nozzle or turbulator is attached at the lower end of a cold water supply pipe, typically called a dip tube. The dispersed sediment is then evacuated from the water heater through the water outlet. The sediment is next discharged at the water faucet or is trapped in the faucet strainers. The sediment trapped in the strainers should be eventually cleaned by unscrewing the strainer. Other water heaters have a manually operated sediment drain valve to drain the accumulated sediment from the bottom of the water heater.

For example, Syler, U.S. Pat. No. 4,505,231, discloses a water heater including a curved tube through which cold water flows each time water is withdrawn from the water heater tank. The curved tube is located toward the bottom of the water heater tank and includes openings through which streams of water are directed into the tank. The streams of water agitate the water in the bottom of the tank, allegedly to prevent accumulation of the sediment in the tank. The streams of water produce a swirling action in the bottom portion of the tank to provide the alleged beneficial result. The suspended particles are stated to be carried upwardly in the tank and eventually out of the tank through an outlet at the very top of the tank.

Taylor, U.S. Pat No. 3,762,395, discloses a somewhat similar arrangement wherein water issuing through an outlet at a bottom portion of a vertically extending cold water inlet or dip tube in a water heater tank provides a tangential jet of water to allegedly prevent a build up of sediment on the bottom of the tank. In the Taylor patent, the sediment is agitated upwardly to a drain cock located considerably above the bottom of the tank, but below the outlet of the dip tube.

Based on a video of the operation of a water heater using concepts similar to those disclosed in the Taylor and Syler patents, a substantial amount of sediment would appear to remain in the tanks of these prior art water heaters, both of which rely on a swirling action of the cold water entering the tank to agitate the sediment. The video indicates a relatively small percentage of sediment flows through a drain cock similar to that disclosed in the Taylor patent. Hence, the prior art devices do not appear to substantially prevent the accumulation of sediment, despite claims to the contrary.

It is, accordingly, an object of the present invention to provide a new and improved method of and apparatus for substantially preventing sediment accumulation in a water heater.

Another object of the invention is to provide a new and improved water heater of the residential type having greater efficiency than prior art residential water heaters as a result of sediment being substantially removed from the water heater.

An additional object of the present invention is to provide a water heater wherein sediment flows gently to a bottom portion of the water heater, and is removed without being agitated.

SUMMARY OF THE INVENTION

In accordance with one aspect of the present invention, a residential water heater, either of the electric or gas type, is arranged and operated so that sediment is gently washed to the lowest point of a tank of the heater every time water is drawn from the tank so the sediment can be flushed from the bottom of the tank from time to time. The gentle washing of the sediment is performed without swirling the water or agitating the sediment and without substantial turbulence in the water. The gentle washing gently sweeps the sediment along a horizontally and vertically extending sloping wall at a bottom portion of the tank, causing the sediment to slide or drift along the sloping wall toward the bottom of the tank, where it accumulates. The sediment and the water carrying it are incident on the sloping wall with such a low speed that the sediment does not bounce off the sloping wall. A normally closed drain is selectively opened from time to time, preferably periodically, such as once a day, to remove the sediment accumulated at the tank bottom.

In the preferred embodiment, gentle rinsing of the sediment is performed by connecting the bottom of a cold water dip tube in the tank to a manifold having a number of openings in it. The openings are preferably slits, that can be angled relative to the direction of water flow through the manifold and/or at right angles to the direction of water flow in the manifold.

In the preferred embodiment, the manifold is in the form of a tube configured as a ring connected to the bottom of the dip tube by a T connector so that water flows from the dip tube in opposite directions through oppositely directed arms of the T into different ends of the manifold tube. In one embodiment, the slits were arranged so that in each half of the ring, the slits which are angularly disposed are in the direction of flow. To assist in the gentle rinsing of the sediment to the bottom of the tank, and prevent agitation of the sediment above the manifold, the slits are confined to the lower half of metal tubing forming the manifold. In one configuration, the slit width was approximately 1/16 of an inch and extended about the lower half of the periphery of a ½ inch diameter tube. Experiments indicated these dimensions were optimum.

In electric water heaters incorporating the invention, the drain is in the center of the tank and the tank has a conical wall between its cylindrical side wall and the drain. We have found, through experimentation, that the preferential angle for the conical wall is at least 42 degrees below a horizontal plane at the intersection of the conical and cylindrical walls. In a 14 month test of a modified 32 gallon residential electric water heater, wherein the sediment was evacuated on a daily basis from the drain simultaneously with removal of approximately a half gallon of water, no sediment whatsoever was in the bottom of the tank and only a very small amount of sediment had accumulated on the heater heating coils. This was in a residence without a water softener, operating in a region of the United States having significantly hard water.

The invention is also applicable to gas water heaters. However, it is not possible in a typical gas water heater to include a central drain because gas water heaters have a burner below the bottom wall of the water enclosing tank and a centrally located flue. To enable sediment to be withdrawn from gas water heaters incorporating the present invention, such heaters include a conical surface that extends outwardly from a central portion of the water heater, at the periphery of the flue. The conical surface extends outwardly toward the water heater cylindrical exterior wall. The drain is located on one side of such a conical wall, in proximity to the water heater cylindrical wall, at the lowest point in the tank. The conical wall is arranged so that the bottom edge thereof is connected to a pair of downwardly inclined runways. Each runway preferably has a nadir at the bottom of the tank and a zenith diametrically opposite from its nadir. The sediment descends by gravity along these runways to the tank bottom and flows from the drain from time to time.

The above and still further objects, features and advantages of the present invention will become apparent upon consideration of the following detailed descriptions of several specific embodiments thereof, especially when taken in conjunction with the accompanying drawings.

DETAILED DESCRIPTION OF THE INVENTION

Figure 2:
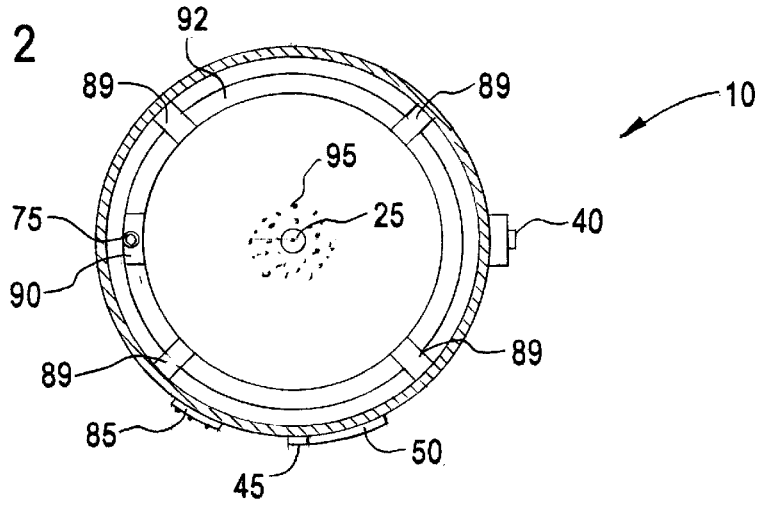
FIG. 2 is a top sectional view of FIG. 1 taken along lines 2—2.

The electric water heater of FIGS. 1–4 includes closed tank 10 having an upper section containing outer vertically extending cylindrical wall 15 and a lower section having a conical wall 20 that has a downward constant slope, i.e., inclination, angle $\alpha$ of at least 42 degrees from the horizontal. The bottom of conical wall 20, at central drain 21, is connected to pipe 24, thence to enlarged elbow 25, which is connected to manual ball valve 30, in turn connected to automatic solenoid operated drain valve 35 which is connected to a pipe. Thus, the electric water heater of FIGS. 1–4 includes: bottom portion conical wall 20 intersecting outer vertical wall 15, wherein the conical wall slopes downwardly from its intersection 26 with outer vertical wall 15 toward a central vertical axis of tank 10 where drain 21 is located. Drain valve 35 is actuated by timer controller 40 which can be adjusted for the length of valve opening and the time of day. Typically, valve 35 is opened daily, e.g. in the middle of the night, for a period sufficient to evacuate about a half gallon of water from tank 10.

The water temperature is set by electric heaters 45 and adjustable temperature controller 50. For clarity, the drawing does not include heater insulation which covers all sections of the heater and hot water pipe 60. Penetrating heater roof 65 are pressure and temperature relief valves 70, cold water inlet pipe 75 (frequently referred to as a dip tube) and corrosion reducing anode 80. Hand hole cover 85 provides access to the tank interior for manual cleaning and inspection.

Figure 1:
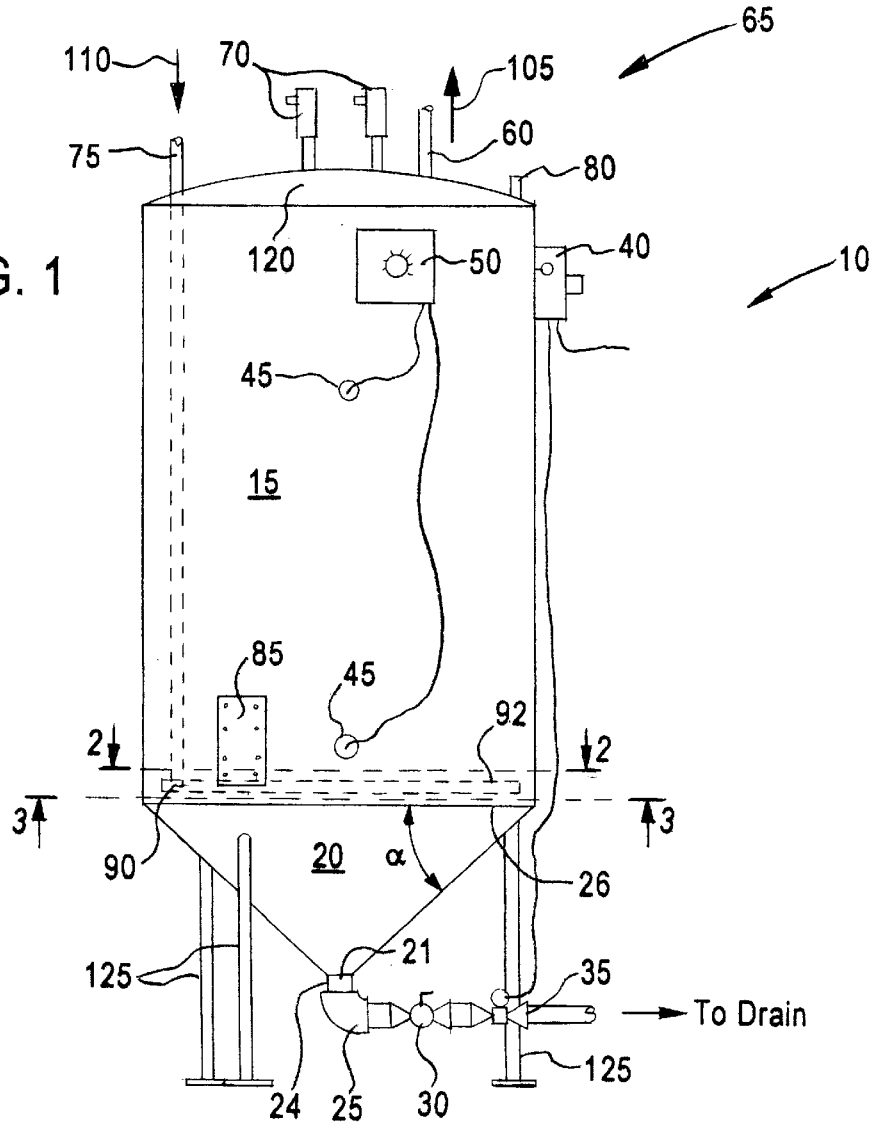
FIG. 1 is a front elevation view of an electric water heater in accordance with a preferred embodiment of the invention.
Figure 3:
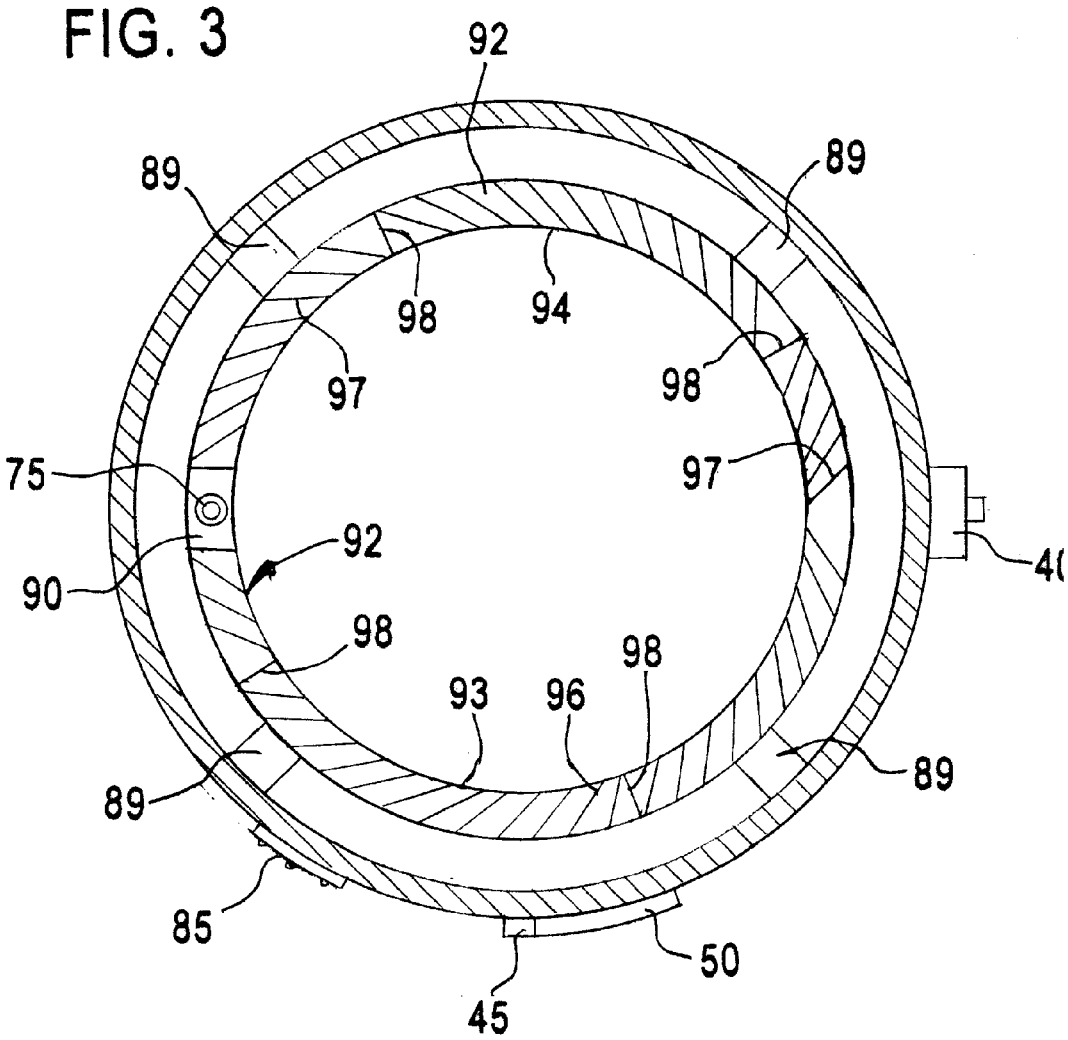
FIG. 3 is a bottom sectional view of FIG. 1, taken along lines 3—3.
Figure 4:
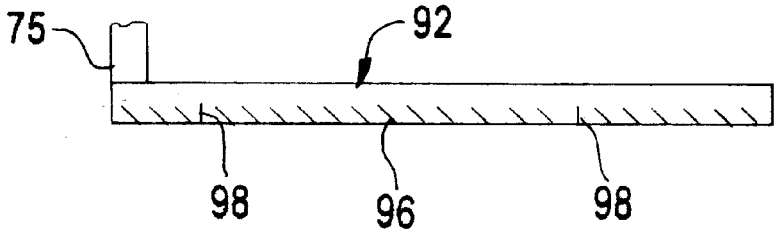
FIG. 4 is a side view of a manifold included in the heater of FIGS. 1–3.

As illustrated in FIGS. 1 and 2, the bottom end of dip tube 75, just above horizontal intersection 26 between cylindrical wall 15 and conical wall 20, is connected to T pipe 90, having horizontally disposed opposite ends connected to opposite ends of metal tube 92. Tube 92 is shaped as a ring, held in place by hangers 89 (not shown in FIG. 1 to simplify the drawing) so the tube outer surface is about an inch from the interior surface of wall 15, to hold tube 92 so that the tube is mounted essentially horizontally about an inch above intersection 26.

Tube 92 is a generally horizontally extending manifold including a plurality of openings dimensioned and arranged so the cold water flows gently from the tube through the openings without causing turbulence in the water in the remainder of tank 10. The openings do not have a nozzle effect and have an area such that the flow rate of water passing through them does not cause turbulence to the water or sediment in tank 10. The openings are only in a bottom portion of tube 92, such that water flowing through the opening does not flow upwardly in tank 10.

To these ends, tube 92 includes three sets 96, 97 and 98 of slits. In an actual water heater built in accordance with the invention, tube 92 included a total of 48 slits.

In essence, tube 92 includes first and second segments 93 and 94, respectively connected to the opposite ends of T 90 so that the cold water in dip tube 75 flows from the dip tube into segments 93 and 94 in opposite directions from the T, which thus forms a common point for the water to flow in opposite directions.

The angled slits in set 96 are in segment 93 and the angled slits in set 97 are in segment 94. The slits in sets 96 and 98 in both segments 93 and 94 are angled in the same direction as the laminar flow of water in these segments. The slits in set 98 that are in segments 93 and 94 are substantially perpendicular to the direction of laminar flow of water in tube 92. In the actually constructed water heater, there was a total of 48 slits; 22 slits in set 96, 22 slits in set 97, and four interspersed right angle slits in set 98. Each slit had a width of about 1/16 inch and a length of about 1 ½ inches. The slits of sets 96 and 97 are tilted about 20 degrees relative to the direction of laminar water flow in tube 92.

In response to water being removed from tank 10, cold water flows from dip tube 75 into tube 92, thence through the slits in sets 96–98 into the bottom portion of tank 10. Water flows through the slits in sets 96–98 in response to water flowing out of hot water pipe 60 or opening of drain valve 35. In both cases, water enters cold water pipe 75 as shown at arrow 110, causing water to flow through the slits in sets 96–98. The water flowing through the slits in sets 96–98 gently washes sediment in the bottom portion of the tank toward conical horizontally and vertically extending wall 20. The inclination angle, $\alpha$, of wall 20 below the horizontal plane is such that the washed sediment 95 accumulates at and in proximity to drain 21. Controller 40 automatically opens valve 35 from time to time, e.g., periodically, to remove the washed sediment 95 from the bottom portion of tank 10 via drain 21 to prevent accumulation of substantial sediment in the tank. We found through experimentation that optimum results occur if the inclination angle of wall 20 below the horizon is at least 42 degrees, but believe that the inclination angle could be as low as 35 degrees to provide adequate results.

In the electric water heater that was actually tested, tank 10 had convex top 120 and vertical sides about 40 inches long. Conical wall 20 was about 12 inches high and terminated at drain 21, having a 1.5 inch diameter drain 21 which was connected to 90° elbow 25. A bell reducer reduced the piping diameter from 1.5 inches to 1.25 inches. Ball valve 30 was made of stainless steel to isolate stainless steel solenoid valve 35 for maintenance or replacement. Tank 10 was about two feet in diameter and had a volume of about 33 gallons. Three legs 125 supported tank 10 to accommodate uneven floors. The tank material was stainless steel and surrounded by foam insulation and a thin metal shell. It is to be understood that the tank can be manufactured in sizes and materials different from those specified.

The electrical components included two 4500 watt heating coils 45, temperature controller 50, solenoid valve 35 and timer and valve controller 40. Timer and valve controller 40 was adjusted to activate solenoid valve 35 for varying durations and frequencies depending on the hardness of the water and amount of particulate residue in the water. In our test, the timer was set to actuate the solenoid valve 35 for about 3 seconds during the middle of the night. Depending on water pressure and component sizes, in this 3-second period about one cubic foot of water was discharged through drain 21. This one cubic foot of water drained only the cool water located in the lower portion of tank where conical wall 20 is located. The hot water above lower heating coil 45 was not discharged since the lower coil 45 was about 4 inches above the top of inverted cone 20. After the water heater constructed as stated operated 14 months, it was found that no sediment accumulated in tank 10, despite the water heater being operated in a residence supplied with hard water and without a water softener.

Figure 5:
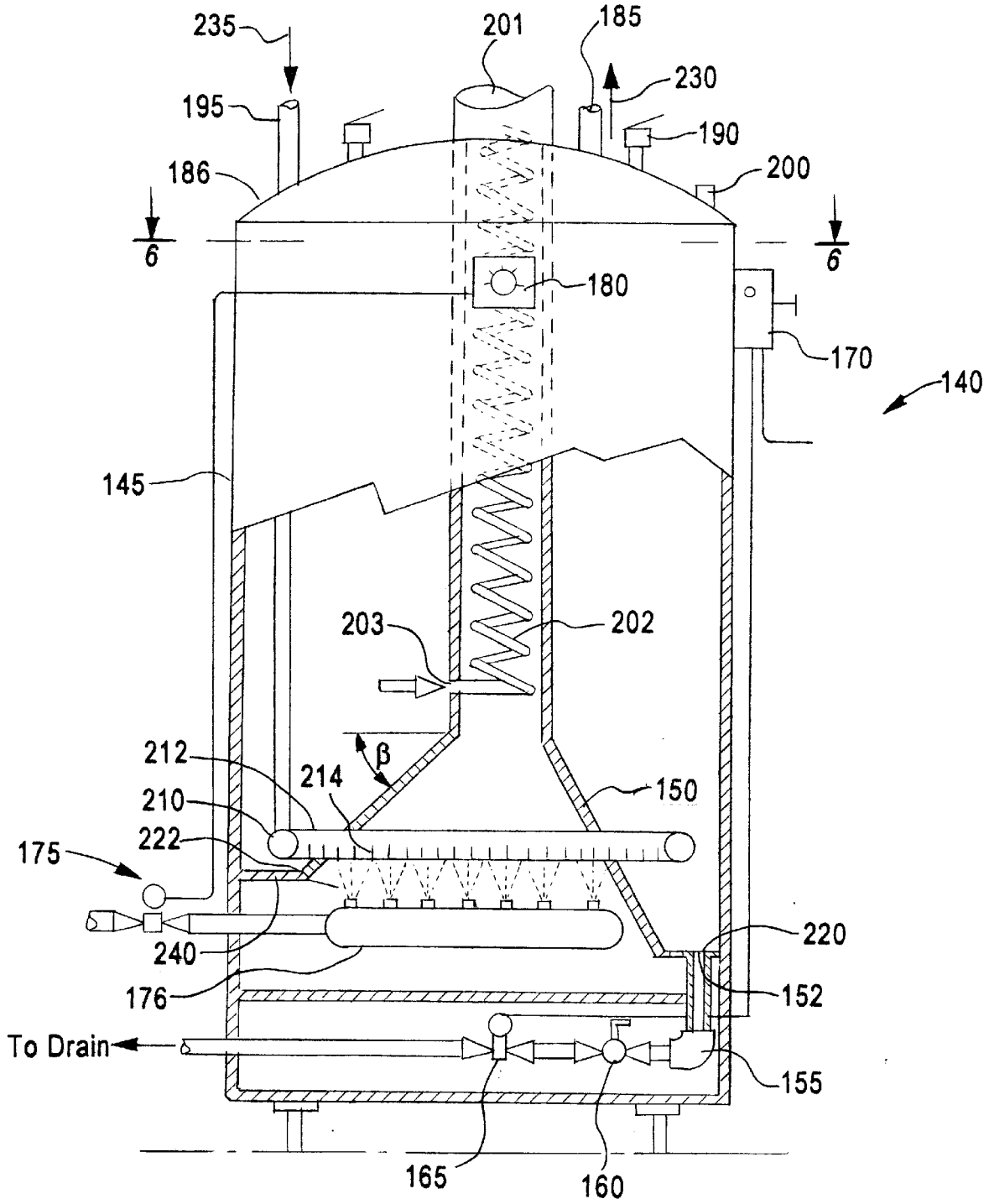
FIG. 5 is a front elevation and section view of a gas-fired water heater.
Figure 6:
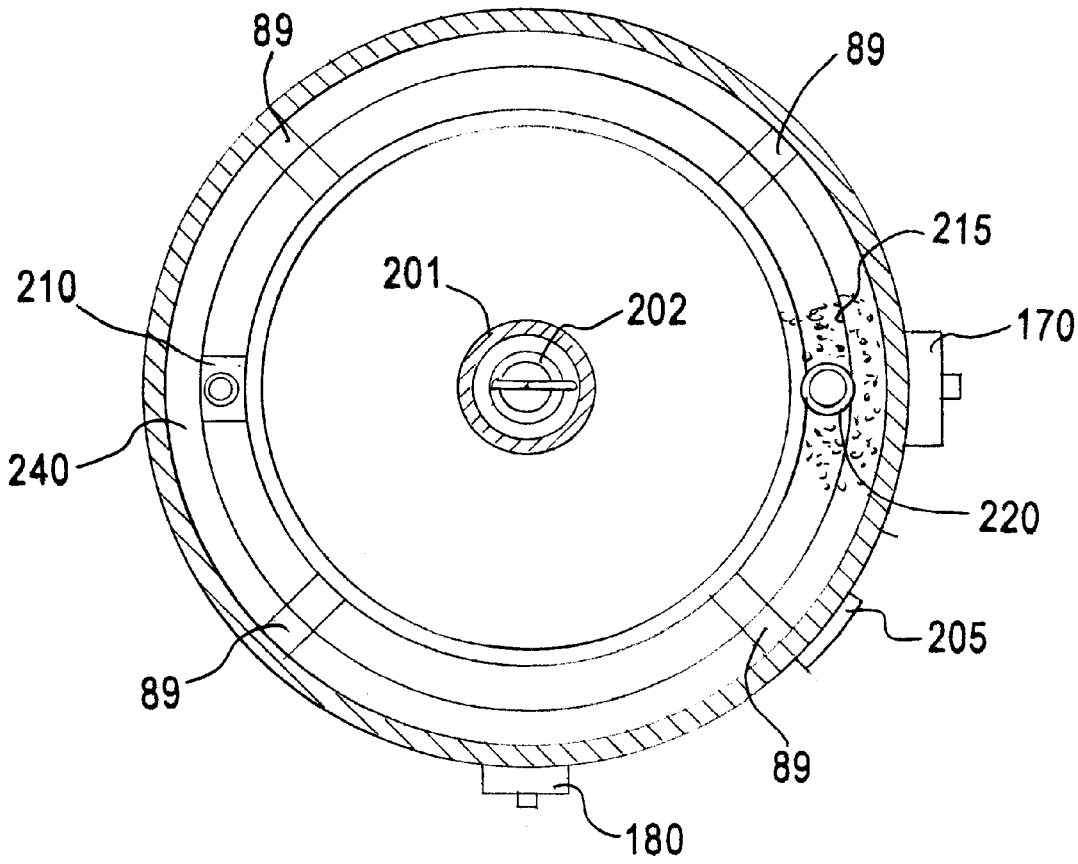
FIG. 6 is a top section view taken along lines 6—6 of FIG. 5.

The gas fired heater illustrated in FIGS. 5 and 6 includes tank 140 having cylindrical wall 145 and lower section including an inverted conical wall 150 having a minimum downward slope angle, $\beta$, of at least 42 degrees from the horizontal for optimum operation. Drain 152, at the bottom of inverted cone 150, is adjacent to elbow 155, connected to manual ball valve 160, in turn connected to automatic solenoid operated drain valve 165. Drain valve 165 is actuated by timer/controller 170 which is adjusted to control the valve opening duration and the time of day the valve is opened.

The water heater temperature is set by (1) gas control valve 175, (2) annular gas jet manifold 176, which is located under cone 150 to preclude water contact with the flame, and (3) adjustable temperature controller 180. For clarity, the drawing does not show heater insulation which covers all sections of the heater and hot water outlet pipe 185. Penetrating the heater top section 186 are pressure and temperature relief valves 190, cold water inlet pipe 195, and corrosion reducing anode 200. Flue pipe 201 penetrates the center of the top section 186 and extends down to the top of inverted cone 150. Within flue pipe 201, is tubing coil 202 that, by convection, moves cool water in tank 140 from inlet 203 of flue pipe 201, to an outlet (not shown) near the top cover 186. Handhold cover 205 provides access to the tank interior for manual cleaning and inspection.

Because gas jet manifold 176 is below cone 150 and flue pipe 201 is located in the center of tank 140, drain 152 cannot be centrally located. Consequently, drain 152 is located in proximity to exterior wall 145, at the lowest portion 220 of flange 240 that extends from the lowest edge of cone 150 and is bonded, e.g., by seam welding or soldering, to wall 145. Cone 150 forms a vertically and horizontally extending bottom wall portion of tank 140. The bottom edge of cone 150 has a zenith point 222 diametrically opposite from drain 152, which is at the nadir of the cone bottom edge. In each vertical cross section of tank 140, flange 240 extends horizontally between the bottom edge of cone 150 and wall 145. Flange 240 extends continuously and smoothly around the circumference of the bottom edge of cone 150, between zenith point 222 and drain 152 to, in effect, provide a runway for sediment incident on the flange and cone 150. The inclination angle $\beta$ of the horizontally and vertically extending wall of cone 150 relative to the horizontal plane is such that washed sediment in tank 140 drifts by gravity along the wall of cone 150 to the runway flange 240 forms. Inclination angle $\beta$ continuously varies from a minimum angle along a straight line of the wall segment between flue 201 and zenith point 222 to a maximum angle along a straight line of the wall segment between flue 201 and nadir 220. The inclination angle of the runway between zenith point 222 and drain 152 is such that the washed sediment incident on the runway also drifts by gravity to the drain. Experiments have shown that the optimum minimum inclination angle $\beta$ is 42 degrees below a horizontal plane extending through a horizontal intersection of cone 150 and flue 201.

At the lowest end of dip tube 195 is horizontally extending T 210 for directing cold water horizontally in two directions into manifold 212. Manifold 212 is connected to the bottom of cold water inlet tube 195 and fixedly mounted by hangers (not shown) just above zenith point 222. Manifold 212 is shown as being horizontally disposed, but it is to be understood that the manifold could be inclined so it is a fixed distance above flange 240. Manifold 212 includes many slits 214 completely along its length. The slits 214 are only in the lower half of the metal tubing forming manifold 212. Manifold 212 is similar to manifold 92 in that slits 214 are dimensioned and arranged so the cold water flows gently through slits 214 without causing turbulence to the sediment and/or water in tank 140. Slits 214 in manifold 212 can achieve this result by having the same dimensions as the slits of manifold 92. Slits 214 differ from the slits of manifold 92 because all of slits 214 are perpendicular to the direction of laminar water flow in the annular tube forming manifold 212. One actually built manifold 212 has 48 slits 214, spaced 1 inch from each other along the circumference of the manifold.

In response to water exiting hot water pipe 185, shown by arrow 230, or opening of drain valve 165, cold water enters cold water pipr 195 as shown at arrow 235, causing water to flow from slits 214 to gently wash sediment in tank 140 to the wall of cone 150, thence to the runway that flange 240 forms and to drain 152.

This gas water heater has convex top 186 and vertical sides of about 40 inches. The bottom edge of cone 150 at zenith point 222 is about 8 inches below the bottom of flue 210; at nadir 220, the cone bottom edge is about 12 inches below the bottom of flue 210. A 1.5 inch diameter outlet and a 90 degree elbow 155 are connected adjacent to drain 152, at nadir 220 of cone 150. A bell reducer reduces the piping from 1.5 inch diameter to 1.25 inch diameter. Stainless steel ball valve 160 isolates stainless solenoid valve 165 for maintenance or replacement. Tank 140 is about 2 feet in diameter and has a volume of about 33 gallons. Stainless steel inlet dip tube 195 terminates at the 90 degree T 210 about one inch above the bottom edge of cone 150. Three legs support the tank and can therefore accommodate uneven floors. The preferred tank material is stainless steel surrounded by foam insulation and a thin outer metal shell.

The electrical components include solenoid valve 165 and timer and valve controller 170. Timer and valve controller 170 is adjusted to activate solenoid valve 165 for varying durations and frequencies depending on the hardness of the water and amount of particulate residue in the water.

Although the materials referred to for construction are stainless steel, a less expensive heater could be made from a glass-lined carbon steel body using copper pipe and bronze valves.

While the present invention has been described by reference to specific embodiments, it will be apparent that other alternative embodiments and methods of implementation or modification may be employed without departing from the true spirit and scope of the invention.

We claim:

1. A water heater comprising a closed tank having a vertical exterior wall arrangement and a bottom portion with a wall extending horizontally and vertically to a normally closed bottom drain, a valve arrangement coupled to the bottom drain for selectively enabling water flowing through the bottom drain to flow through it, a hot water outlet connected to the tank interior, a cold water inlet having a segment in proximity to the horizontally and vertically extending wall, the cold water inlet being arranged so that in response to water being removed from the tank, cold water flows from the inlet into the bottom portion to gently wash sediment in the bottom portion toward the horizontally and vertically extending wall, the horizontally and vertically extending wall being arranged so the washed sediment drifts by gravity to the drain and the drifted sediment accumulates at and in proximity to the drain, and a controller for opening the valve from time to time for removing the washed sediment from the bottom portion via the drain and preventing accumulation of substantial sediment in the tank.

2. The water heater of claim 1 wherein the cold water inlet segment comprises a generally horizontally extending manifold.

3. The water heater of claim 2 wherein the manifold includes a plurality of openings dimensioned and arranged so the cold water flows gently through them without causing turbulence in the water in the remainder of the tank.

4. The water heater of claim 3 wherein the manifold comprises a tube, the openings being only in a portion of the tube such that water flowing through the openings does not flow upwardly.

5. The water heater of claim 4 wherein the openings do not have a nozzle effect and have an area such that the flow rate of water passing through them does not cause water or sediment turbulence.

6. The water heater of claim 5 wherein the openings include slits angled in the direction of flow of water in the tube.

7. The water heater of claim 5 wherein the openings include slits substantially at a right angle relative to the direction of flow of water in the tube.

8. The water heater of claim 5 wherein the openings consist of first slits angled in the direction of flow of water in the tube, interspersed with second slits substantially at a right angle relative to the direction of flow of water in the tube, the number of first slits being substantially greater than the number of second slits.

9. The water heater of claim 8 wherein the tube includes first and second segments arranged so that the cold water flows in the first and second segments in opposite directions from a common point, the angled slits in both segments being angled so that the slits in both segments are angled in the same direction as the water flowing therein.

10. The water heater of claim 5 wherein the tube includes first and second segments arranged so that the cold water flows in the first and second segments in opposite directions from a common point.

11. The water heater of claim 10 wherein the tube is shaped as a ring so that cold water flowing into the first and second segments intersects in the tube.

12. The water heater of claim 1 wherein the water heater includes an electric heating coil, the bottom portion wall intersecting the outer vertical wall arrangement and sloping downwardly from its intersection with the outer vertical wall toward a central axis of the tank where the drain is located.

13. The water heater of claim 12 wherein the bottom portion wall is conical and has a constant inclination angle, the inclination angle being at least 42 degrees below a horizontal plane.

14. The water heater of claim 12 wherein the cold water inlet segment comprises a generally horizontally extending manifold.

15. The water heater of claim 14 wherein the manifold includes a plurality of openings dimensioned and arranged so the cold water flows gently through them without causing turbulence in the water or the sediment in the tank.

16. The water heater of claim 1 wherein the water heater includes a gas burner and a central flue in fluid flow relation with combustion products of the gas burner, the gas burner being below the bottom portion wall, the bottom portion wall having an intersection with the flue and sloping downwardly from its intersection with the flue toward the outer vertical wall arrangement, the bottom portion wall having a sloping bottom edge having a nadir at the drain and a runway between the sloping bottom edge and the outer vertical wall arrangement; the cold water inlet segment, the bottom portion wall, the runway and the drain being arranged so that the washed sediment drifts to the bottom portion wall, thence drifts by gravity to the runway, thence drifts by gravity to the drain.

17. The water heater of claim 16 wherein the sloping bottom edge and the runway have a zenith opposite the drain.

18. The water heater of claim 16 wherein the bottom portion wall is conical and has an inclination angle of at least 42 degrees below a horizontal plane.

19. The water heater of claim 16 wherein the cold water inlet segment comprises a generally horizontally extending manifold.

20. The water heater of claim 19 wherein the manifold includes a plurality of openings dimensioned and arranged so the cold water flows gently through them without causing turbulence in the water in the remainder of the tank.

21. A method of preventing substantial accumulation of sediment in a tank of a residential water heater, the tank having a vertical outer wall arrangement and a bottom portion with a wall extending horizontally and vertically so it tapers to a normally closed bottom drain, a valve arrangement coupled to the bottom drain for selectively enabling water and sediment flowing through the bottom drain to flow through it, a hot water outlet connected to the tank interior, a cold water inlet having a segment in proximity to the bottom portion wall, the method comprising causing cold water to flow through the inlet into the bottom portion to gently wash sediment in the bottom portion toward the horizontally and vertically extending wall in response to water being removed from the tank, causing the washed sediment to drift by gravity along the bottom portion wall to the bottom drain so the drifted sediment accumulates at and in proximity to the drain, and opening the valve from time to time to remove the washed sediment and some water from the bottom portion via the drain and prevent accumulation of substantial sediment in the tank.

22. The method of claim 21 wherein the cold water flow causing step includes causing cold water to flow gently through a plurality of openings in the cold water inlet without causing substantial turbulence in the water or the sediment in the tank.

23. The method of claim 22 wherein the cold water flows through the openings which are close to the tank outer wall arrangement and close to the bottom portion wall.

24. The method of claim 21 wherein the valve is automatically opened periodically.

25. The method of claim 21 wherein the valve is automatically opened daily.

* * * * *